US011619023B2

(12) United States Patent
Rhomberg et al.

(10) Patent No.: US 11,619,023 B2
(45) Date of Patent: Apr. 4, 2023

(54) MODULAR SLURRY WALL CUTTER

(71) Applicant: LIEBHERR-WERK NENZING GMBH, Nenzing (AT)

(72) Inventors: Johannes Rhomberg, Satteins (AT); Florian Gabriel, Frastanz (AT)

(73) Assignee: LIEBHERR-WERK NENZING GMBH, Nenzing (AT)

( * ) Notice: Subject to any disclaimer, the term of this patent is extended or adjusted under 35 U.S.C. 154(b) by 535 days.

(21) Appl. No.: 16/746,766

(22) Filed: Jan. 17, 2020

(65) Prior Publication Data

US 2020/0232183 A1 Jul. 23, 2020

(30) Foreign Application Priority Data

Jan. 18, 2019 (DE) ..... 10 2019 101 305.4

(51) Int. Cl.

| | |
|---|---|
| ***E02F 3/24*** | (2006.01) |
| ***E02F 3/18*** | (2006.01) |
| *E02F 9/08* | (2006.01) |
| *E02F 3/20* | (2006.01) |
| *E02F 3/22* | (2006.01) |

(52) U.S. Cl.

CPC ..... *E02F 3/241* (2013.01); *E02F 3/188* (2013.01); *E02F 3/205* (2013.01); *E02F 3/22* (2013.01); *E02F 9/0808* (2013.01)

(58) Field of Classification Search

CPC . E02F 3/188; E02F 3/241; E02F 3/205; E02F 3/22; E02F 3/9237; E02F 3/8816; E02F 3/905; E02F 9/0808; E02F 5/08

See application file for complete search history.

(56) References Cited

U.S. PATENT DOCUMENTS

| | | | | |
|---|---|---|---|---|
| 4,352,250 A * | 10/1982 | de Vries | E02F 3/90 37/336 |
| 7,114,271 B2 * | 10/2006 | Chagnot | E02F 3/205 37/468 |
| 10,392,233 B2 * | 8/2019 | Mayer | B66C 23/74 |

(Continued)

FOREIGN PATENT DOCUMENTS

| | | |
|---|---|---|
| CN | 106223381 A | 12/2016 |
| JP | H07238550 A | 9/1995 |
| WO | 2009132025 A2 | 10/2009 |

OTHER PUBLICATIONS

National Intellectual Property Administration of the People's Republic of China, Office Action and Search Report Issued in Application No. 202010067990.6, dated Nov. 30, 2021, 16 pages. (Submitted with Partial Translation).

*Primary Examiner* — Jessica H Lutz
(74) *Attorney, Agent, or Firm* — McCoy Russell LLP

(57) ABSTRACT

The application relates to a modular slurry wall cutter for preparing a slurry trench that is connectable to a carrier machine, said slurry wall cutter having a frame and at least one cutting tool arranged at the frame to break up soil material. The frame here comprises an upper frame part, a middle frame part, and a lower frame part that are releasably connectable to one another, with the upper and lower frame parts being releasably connectable to one another both directly and via the middle frame part that can be arranged therebetween. The application further relates to a carrier machine, such as to a cable excavator, having a slurry wall cutter in accordance with the application.

18 Claims, 3 Drawing Sheets

(56) References Cited

U.S. PATENT DOCUMENTS

| | | | | |
|---|---|---|---|---|
| 10,480,147 | B2 * | 11/2019 | Cascarino | E02D 17/13 |
| 10,570,580 | B2 * | 2/2020 | Coudry | E02F 3/9218 |
| 10,934,140 | B2 * | 3/2021 | Konijn | B66C 23/72 |
| 2021/0270000 | A1 * | 9/2021 | Rodriguez | E02F 3/205 |

* cited by examiner

MODULAR SLURRY WALL CUTTER

CROSS REFERENCE TO RELATED APPLICATIONS

This present application claims priority to German Application No. 10 2019 101 305.4 filed on Jan. 18, 2019. The entire contents of the above listed application are hereby incorporated by reference for all purposes.

TECHNICAL FIELD

The present application relates to a slurry wall cutter for preparing a slurry trench that is connectable to a carrier machine, said slurry wall cutter having a frame and at least one cutting tool arranged at the frame to break up soil material. The application further relates to a carrier machine, such as a cable excavator, having a slurry wall cutter in accordance with the application.

BACKGROUND

Slurry wall cutters are used to prepare slurry trenches for the construction of slurry walls and are available in the most varied designs and sizes. Slurry wall cutters are typically mounted on mobile carrier machines such as mobile cranes or cable excavators. Every field of use makes special demands here. These demands can, for example, relate to size restrictions of the slurry wall cutter and of the carrier machine due to limited working space. For this reason, so-called compact slurry wall cutters that have a smaller height and are often likewise mounted on smaller carrier machines are typically used in environments with limited working space.

A compact slurry wall cutter comprises all the basic elementary functions and components of a conventional slurry wall cutter with a simultaneously smaller overall geometry. The height of the compact slurry wall cutter is typically considerably smaller to enable an introduction into the slurry trench with a lower working height of the overall system. A disadvantage of such compact slurry wall cutters is the reduced stability in the slurry trench so that they are normally only used when a standard slurry wall cutter cannot be used.

To cover the different areas of use and demands slurry wall cutters and carrier machines of different sizes are therefore needed. Different slurry wall cutters and possibly even different carrier machines therefore have to be used for different demands, such as a the maximum permitted working height. It must be taken into account here that every slurry wall cutter represents a very cost intensive purchase.

Against this background, it is one of the objects of the present application to provide a slurry wall cutter that enables a use under different working conditions with different demands with respect to the working height.

This object is achieved in accordance with the application by slurry wall cutters connectable to carrier machines as described herein. One of the slurry wall cutters accordingly comprises a frame and at least one cutting tool arranged at the frame for breaking up soil material. The frame here comprises an upper, a middle, and a lower frame part that are releasably connected to one another, with the upper and lower frame parts being able to be releasably connected to one another both directly and via the middle frame part that can be arranged or mounted therebetween.

The present application makes it possible to cover at least two different areas of use with only one modular slurry wall cutter. This is effected via a conversion process from a longer standard slurry wall cutter having a middle frame part into a shorter compact slurry wall cutter without a middle frame part. The modularity is here based on a division of the frame of the slurry wall cutter into three parts that are compatible with one another and that can be releasably connected to one another.

The slurry wall cutter can thus be adapted to the respective demands due to the modular design of the slurry wall cutter in accordance with the application having an optionally installable middle frame part. It is thereby no longer necessary to make use of separate slurry wall cutters hang different overall heights or lengths for the respective work deployment, which produces a huge cost advantage.

With sufficient space conditions it is thus possible to make use of a standard slurry wall cutter design having an installed middle frame part since the longer construction shape has better properties with respect to stability within the slurry trench. With limited space conditions, the middle frame part can be removed and a shorter compact slurry wall cutter design can thereby be achieved. In this respect, possibly only secondary components such as hose lines running in the middle frame part, etc. have to be adapted, which represents a comparatively small effort.

Provision is made in an embodiment that the at least one cutting tool is arranged at the lower frame part, with at least one drive unit being provided by means of which the at least one cutting tool can be driven and that the at least one drive unit is likewise arranged at the lower frame part.

One of the cutting tools is a cutting wheel, and a plurality of cutting wheels may be provided arranged next to one another and that are rotatable in opposite senses.

Provision is made in a further embodiment that the upper frame part comprises an electronic control unit and/or that the lower frame part comprises a suction opening and a conveying pump in communication therewith to convey excavated material produced by the at least one cutting tool or excavated material mixed with a suspension introduced into the slurry trench.

Provision is made in a further embodiment that the slurry wall cutter is operable both with and without an installed middle frame part. The elements of the slurry wall cutter elementary for the cutting function such as the drives for the cutting tools, a conveying pump, etc. can, for instance, be accommodated in the lower frame part. Further functions or components of the slurry wall cutter such as a control can be accommodated in the upper frame part. In contrast, the middle frame part does not include any components absolutely necessary for the operation of the slurry wall cutter in accordance with the application, but rather only represents a transition part extending the total length of the slurry wall cutter. Only the frame itself and optionally passage lines connecting the upper and lower frame parts are provided here.

Provision is made in a further embodiment that that the slurry wall cutter comprises at least one passage line extending between the upper and lower frame parts. The passage line can, for example, be a conveying hose for conveying excavated material produced by the at least one cutting tool, a supply line for conducting e.g. hydraulic oil, a suspension solution, or concrete to the lower frame part, or an electrical cable. A plurality of identical and/or different passage lines can naturally be present simultaneously, for example a conveying hose, a supply line, and an electrical line.

Provision is made in a further embodiment that the at least one passage line has three separate parts that are respectively arranged at the lower, middle, and upper frame parts and that are releasably connectable to one another by compatible connectors. When the middle frame part is removed, the one or more passage lines can likewise be separated so that the passage line parts in the region of the upper and lower frame parts can be coupled to one another again by means of the compatible connectors and are ready for the operation of the compact slurry wall cutter. The parts of the passage lines that are associated with the middle frame part are therefore removed or installed with it.

Conversely, the upper and lower frame parts are separated from one another for an installation of the middle frame part, and equally the corresponding parts of the one or more passage lines. After the insertion of the middle frame part, the parts of the passage lines are connected to one another by means of the compatible connectors.

An installation and removal of the middle frame part is thereby possible in a particularly simple manner. An extension or shortening of the slurry wall cutter is accompanied by a corresponding extension or shortening of the at least one passage line. The compatible connectors are adapted to the respective present types of passage lines (e.g. conveying hose, supply line, or electrical cable) and can thus accordingly represent electrical, hydraulic, or other suitable connectors or couplings.

Provision is made in a further embodiment that two replaceable passage lines having different lengths are provided, with the shorter passage line being releasably connectable to the slurry wall cutter with a removed middle frame part and the longer passage line being releasably connectable to the slurry wall cutter with an installed middle frame part.

Provision is made in accordance with this embodiment that on a conversion the entire at least one passage line is replaced instead of installing or removing the passage lines of the middle frame part with said frame part. In a design without a middle frame part (compact slurry wall cutter), a correspondingly dimensioned shorter passage line is installed and in a design with an installed middle frame part (standard slurry wall cutter), a correspondingly longer passage line is installed. This naturally applies embodiments with a plurality of passage lines for all the passage lines present. In such embodiments, the passage lines can also extend in a common passage that has a multi-connector for all the passage lines extending therein so that the release or establishing of the connections can be carried out even more simply.

Corresponding connectors likewise have to be provided for this purpose at the components (e.g. conveying pump, control, hydraulic motor, etc.) provided with corresponding passage lines for releasable connection to the passage lines so that they can be removed and installed easily. Corresponding connectors for connecting the passage lines to lines of the carrier machine likewise have to be present.

The slurry wall cutter in accordance with the application can have more than only two different lengths (such as on a use of more than one removable middle frame part), a corresponding number of passage lines of different lengths naturally also have to be present.

Provision is made in a further embodiment that the frame parts have connections for establishing a releasable connection, with the connections of the lower and upper frame parts being compatible both with one another and with the connections of the middle frame part.

Provision is made in a further embodiment that the connections comprise both mechanical connection elements for establishing a mechanical releasable connection of the frame parts and connectors for a releasable coupling of the parts of the passage line, with the connections being designed as a quick-coupling for a simultaneous connection of the frame parts and the parts of the passage line. The mechanical and other (e.g. hydraulic, electrical, etc.) connections thereby do not have to be separately disconnected or established, but the connection rather takes place fast and comfortably via a multi-coupling that simultaneously forms the mechanical connection.

The present application further relates to a carrier machine having a slurry wall cutter in accordance with the application. The carrier machine in some embodiments is a mobile crane or a cable excavator. In this respect, the same advantages and properties obviously result as for the slurry wall cutter in accordance with the application so that a repeat description will be dispensed with at this point.

BRIEF DESCRIPTION OF THE DRAWINGS

Further features, details, and advantages of the application result from the embodiment explained in the following with reference to the Figures.

FIGS. 1-5 are shown approximately to scale.

DETAILED DESCRIPTION

Figure 1:
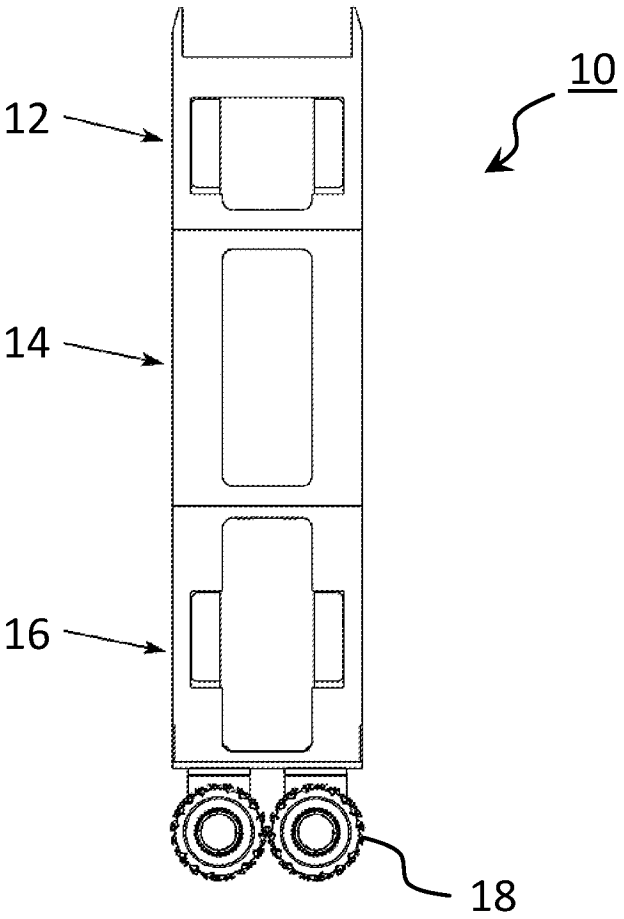
FIG. 1 depicts an embodiment of the slurry wall cutter in accordance with the application with an installed middle frame part (slurry wall cutter) in a schematic side view.

An embodiment of the slurry wall cutter 10 in accordance with the application is schematically shown in a side view in FIG. 1. The slurry wall cutter 10 comprises a frame that comprises three individual frame parts, namely an upper frame part 12, a middle frame part 14, and a lower frame part 16.

A plurality of cutting tools 18 formed as cutting wheels by means of which the slurry trench is prepared are arranged at the lower frame part 16. The soil material of the ground is here broken up by the rotation of the cutting wheels 18. The drive units of the cutting wheels 18 are likewise arranged at the lower frame part 16 and are supplied via corresponding supply lines that extend from the upper frame part 12 to the lower frame part 16.

The lower frame part 16 can furthermore comprise a suction opening to which a conveying pump designed as a centrifugal pump, for example, is connected, for example. A conveying hose via which the broken up soil material sucked in from the suction opening by the pump (optionally together with a suspension introduced into the slurry trench via a supply line) is conveyed out of the slurry trench is in turn connected to said conveying pump.

Hydraulic lines and/or electrical cables can furthermore extend along the slurry wall cutter 10. These aforesaid cables, hoses, and lines (as well as further lines not explicitly listed here) are here together called passage line(s). These passage lines extend along the slurry wall cutter between the upper frame part 12 and the lower frame part 16, that is (if installed) likewise over the middle frame part 14.

Further components such as a control can be provided in the upper frame part 12. The upper frame part 12 can furthermore have a connection point for mounting the slurry wall cutter 10 on a carrier machine. Connector points for connecting the passage lines to corresponding lines of the carrier machine (e.g. for the energy supply or for the transporting away of the broken up soil material) can likewise be present.

Figure 2:
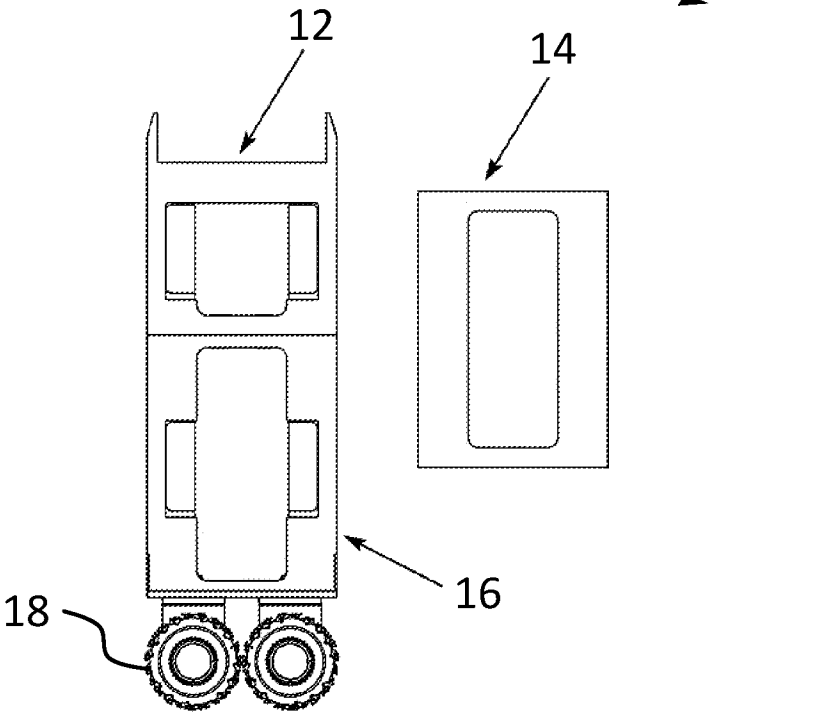
FIG. 2 depicts the embodiment in accordance with FIG. 1 after removal of the middle frame part (compact slurry wall cutter).

In accordance with the application, the slurry wall cutter 10 has a modular design, with the individual frame parts 12, 14, 16 being connectable to one another in an compatible manner. In this respect, the upper and lower frame parts 12, 16 can be connected to one another via the middle frame part 14 to together form a longer standard slurry wall cutter 10 (FIG. 1). The middle frame part 14 can, however, also be removed so that the upper and lower frame parts 12, 16 are directly connected to one another to form a shorter compact slurry wall cutter 10. This design is shown in FIG. 2. The frame parts 12, 14, 16 for this purpose have correspondingly compatible connectors that permit a conversion by inserting or removing the middle frame part 14.

The three frame parts 12, 14, 16 of the slurry wall cutter 10 can therefore either be mounted together as a longer standard slurry wall cutter (see FIG. 1) or without the middle frame part 14 as a shorter compact slurry wall cutter (see FIG. 2). The components are compatible so that the existing frame parts 12, 14, 16 are suitable for both variants. Only subordinate components such as passage lines have to be sporadically adapted or replaced. The modularity thus enables the option of setting two sizes of the slurry wall cutter 10 by a conversion process or retrofitting process.

The passage lines extending between the upper and lower frame parts 12, 16 likewise have to be converted or replaced for a comfortable and fast conversion of the slurry wall cutter 10. This can e.g. take place in that different passage lines of different lengths are provided that are used in the corresponding design variants of the slurry wall cutter 10 (such as shorter passage lines for a shorter compact slurry wall cutter design). Alternatively, beside the mechanical connectors for the mechanical connection of the compatible frame parts 12, 14, 16, corresponding connectors for the different passage lines can be provided so that, for example, on a removal of the middle frame part 14, the corresponding passage lines are also removed and the connectors of the passage lines of the upper and lower frame parts 12, 16 are directly connected to one another to close the respective lines or circuits.

The middle frame part 14 does not comprise any components that are absolutely required for the operation of the slurry wall cutter 10. It can thus be properly operated both with or without the middle frame part 14. The latter only represents a transition part for setting the length of the slurry wall cutter 10 in accordance with the application and has not further function essential for the cutting operation beyond this.

A plurality of middle frame parts 14 that can be arranged between the upper frame part 12 and the lower frame part 16 can naturally be provided instead of a single middle frame part 14 so that a greater combination option and a greater flexibility results with respect to the settable total length of the slurry wall cutter 10. The middle frame parts 14 can all have identical designs or can have different lengths to be able to set the total length of the slurry wall cutter 10 more precisely. The above-described properties and advantages of the slurry wall cutter 10 equally apply to an embodiment having a plurality of (identical or different) middle frame parts 14.

Different areas of use can be covered by the modularity of the slurry wall cutter 10 by a corresponding retrofitting. It is thus not obligatory to use different slurry wall cutters for varying working conditions.

Figure 3:
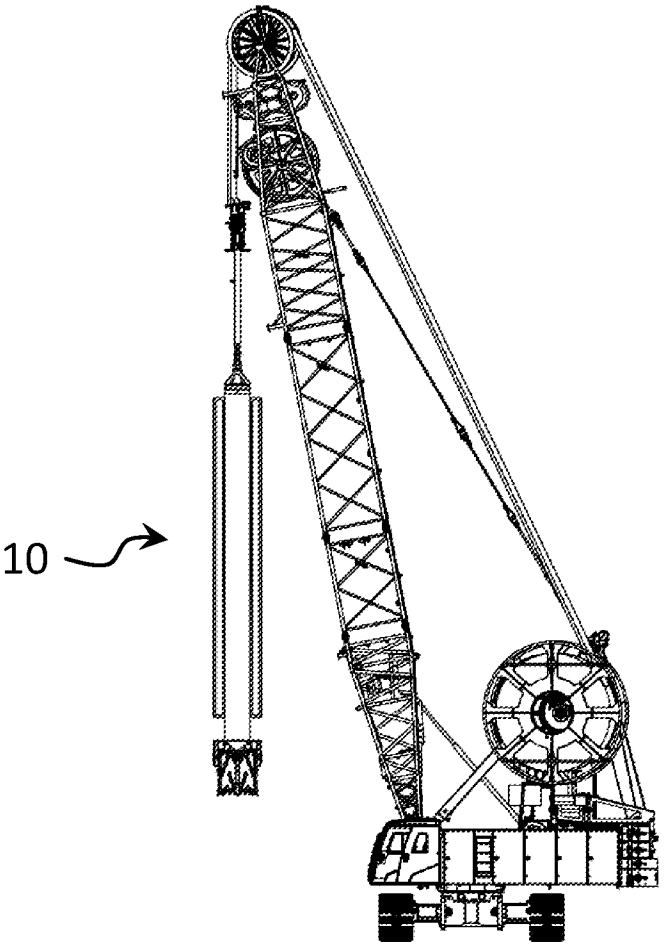
FIG. 3 depicts a side view of a carrier machine having a slurry wall cutter in accordance with the application with an installed middle frame part.
Figure 4:
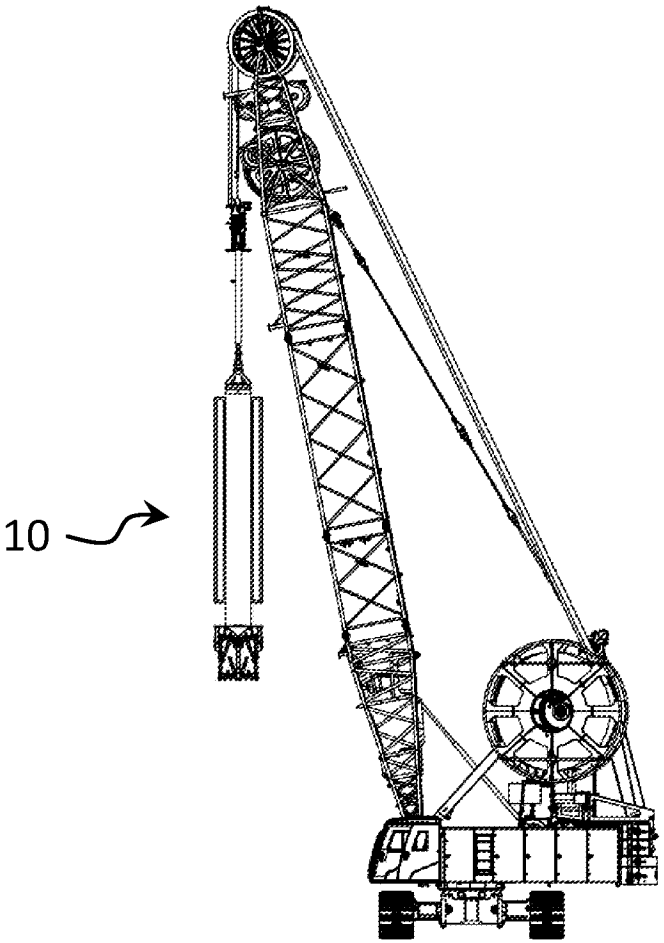
FIG. 4 depicts the carrier machine in accordance with FIG. 3 with a removed middle frame part.

A carrier machine designed as a cable excavator and having a slurry wall cutter 10 in accordance with the application is shown by way of example in a side view in FIGS. 3 and 4. FIG. 3 here shows a design of the slurry wall cutter 10 with an installed middle frame part 14. This longer design represents a standard slurry wall cutter 10 having optimum stability properties such as is typically used with sufficient space conditions. FIG. 4 in contrast shows a design in which the middle frame part 14 has been removed to obtain a shorter compact slurry wall cutter 10. It can, for example, be used in tight space conditions. The same carrier machine and the same components of the slurry wall cutter 10 can be used for this purpose.

The modularity of the slurry wall cutter 10 in accordance with the application in particular brings along the following economic advantages.

An individual modular slurry wall cutter 10 can cover at least two working areas (with different demands on the working height).

The total costs of the modular slurry wall cutter 10 are easily lower than the total costs of the at least two separate conventional slurry wall cutters with which the same conditions of use could be covered.

Different carrier machines can be combined depending on the variant of the slurry wall cutter 10. This makes it possible to use effective assemblies corresponding to the respective work conditions.

The transport is simplified due to the compact transport units (frame parts) thanks to the modular division of the slurry wall cutter 10.

The following application example is intended to illustrate the advantages of the slurry wall cutter 10 in accordance with the application.

A construction company would like to move into the slurry wall cutting business. Due to the high variation in the incoming jobs, a single slurry wall cutter is not sufficient to cover all the areas of use. Since the budget is limited, a purchase of two different slurry wall cutters is not an option. In addition, the company does not want to purchase a second slurry wall cutter that could only be used for special areas of use.

The advantages of the modular slurry wall cutter 10 in accordance with the application can now be fully exploited here. The modular slurry wall cutter 10 can be converted from the longer standard version into the shorter compact version and can thus cover different areas of use by the conversion process or retrofitting process.

The modular slurry wall cutter 10 is also compatible with "smaller" carrier machines as a compact version. Due to the high compatibility of the modular slurry wall cutter 10, this can in turn bring about advantages for further purchases.

Figure 5:
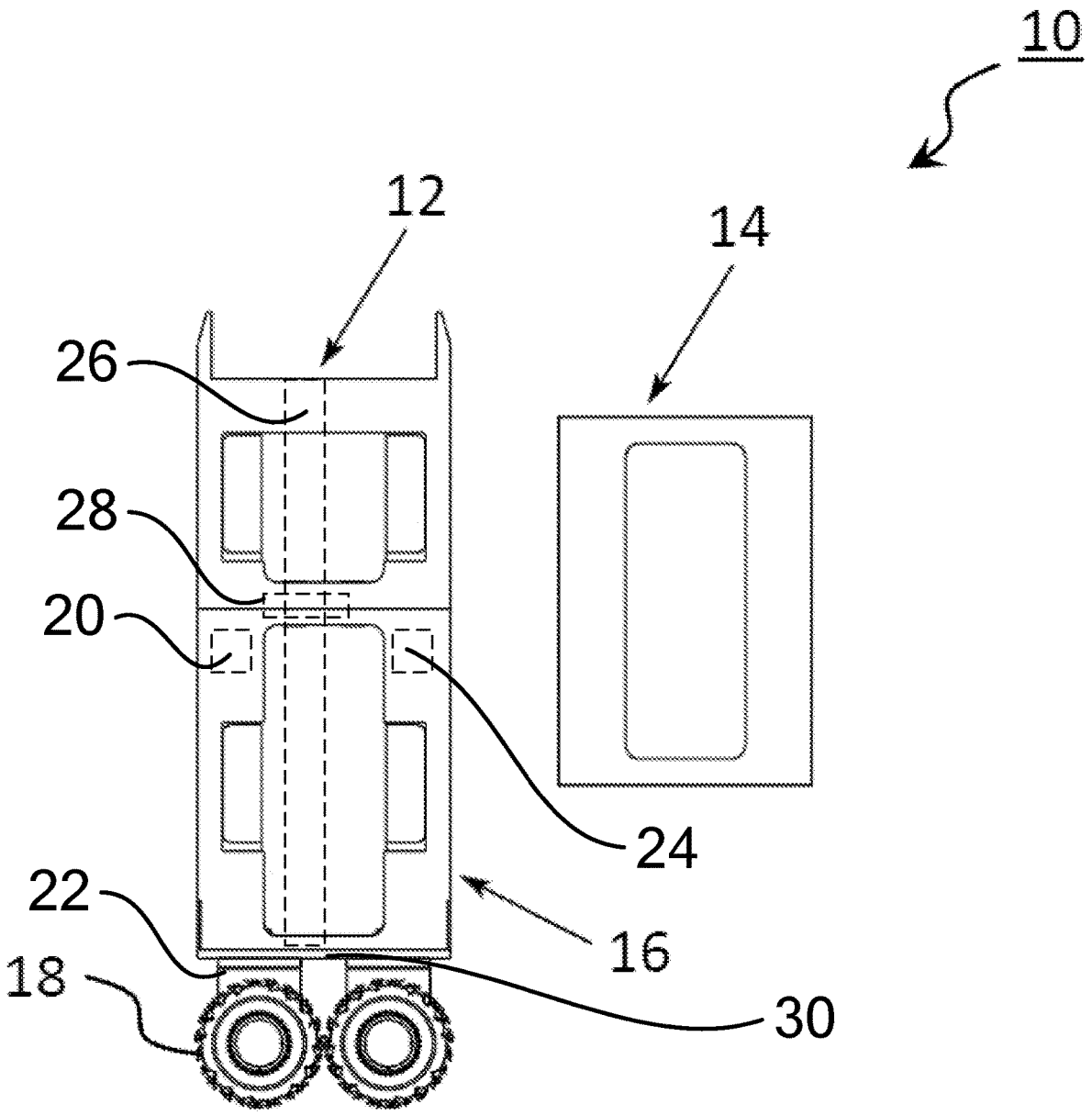
FIG. 5 depicts a further embodiment of a slurry cutter.

FIG. 5 depicts an embodiment of a slurry cutter similar to FIG. 2. In the depicted embodiment, the lower frame part 16 includes an electronic control unit 20, depicted schematically. FIG. 5 further shows the drive units 22 attached to the cutter heads 18 and lower frame part 16. FIG. 5 also depicts a conveying pump 24, depicted schematically, to pump media through a suction opening 30 in the lower frame part 16. Passage lines 26 are also depicted extending through lower frame parts 16 and upper frame part 12. Connections 28 may connect passage lines 26 as well as frame parts such lower frame parts 16 and upper frame parts 12.

FIGS. 1-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

It will be appreciated that the configurations and routines disclosed herein are exemplary in nature, and that these specific embodiments are not to be considered in a limiting sense, because numerous variations are possible. The subject matter of the present disclosure includes all novel and non-obvious combinations and sub-combinations of the various systems and configurations, and other features, functions, and/or properties disclosed herein.

As used herein, the terms "approximately" or "substantially" are construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

REFERENCE NUMERAL LIST

10 slurry wall cutter
12 upper frame part
14 middle frame part
16 lower frame part
18 cutting tool
20 control unit
22 drive unit
24 conveying pump
26 passage lines
28 connections
30 suction opening

The invention claimed is:

1. A slurry wall cutter that is connectable to a carrier machine, said slurry wall cutter comprising:

a frame and at least one cutting tool arranged at the frame to break up soil material, wherein the frame comprises an upper frame part, a middle frame part, and a lower frame part that are releasably connectable to one another, and the upper and lower frame parts being releasably connectable to one another both directly and via the middle frame part that can be arranged therebetween; and at least one passage line extending between the upper and lower frame parts.

2. The slurry wall cutter in accordance with claim 1, wherein the at least one cutting tool is arranged at the lower frame part, and at least one drive unit is connected to the at least one cutting tool such that the at least one cutting tool can be driven and the one drive unit arranged at the lower frame part.

3. The slurry wall cutter in accordance with claim 1, wherein the upper frame part or the lower frame part comprises an electronic control unit; and the lower frame part comprises a suction opening and a conveying pump in communication therewith for conveying excavated material produced by the at least one cutting tool.

4. The slurry wall cutter in accordance with claim 1, wherein the slurry wall cutter is operable both with and without an installed middle frame part.

5. The slurry wall cutter in accordance with claim 1, wherein the at least one passage line comprises three separate parts that are respectively arranged at the lower, middle, and upper frame parts and that are releasably connected to one another by compatible connectors.

6. The slurry wall cutter in accordance with claim 1, wherein two replaceable passage lines of different lengths are provided, with the shorter passage line being releasably connectable to the slurry wall cutter with a removed middle frame part and the longer passage line being releasably connectable to the slurry wall cutter with an installed middle frame part.

7. The carrier machine comprising the slurry wall cutter in accordance with claim 1.

8. The slurry wall cutter in accordance with claim 1, wherein the passage line is a conveying hose for conveying excavated material produced by the at least one cutting tool, a supply line, or an electrical line.

9. A cable excavator comprising the slurry wall cutter in accordance with claim 1.

10. A slurry wall cutter that is connectable to a carrier machine, said slurry wall cutter comprising:

a frame and at least one cutting tool arranged at the frame to break up soil material, wherein the frame comprises an upper frame part, a middle frame part, and a lower frame part that are releasably connectable to one another, and the upper and lower frame parts being releasably connectable to one another both directly and via the middle frame part that can be arranged therebetween, and further wherein the frame parts have releasable connections, and the connections of the lower and upper frame parts being compatible both with one another and with the connection of the middle frame part.

11. The slurry wall cutter in accordance with claim 10, wherein the at least one cutting tool is arranged at the lower frame part, and at least one drive unit is connected to the at least one cutting tool such that the at least one cutting tool can be driven and the one drive unit arranged at the lower frame part.

12. The slurry wall cutter in accordance with claim 11, wherein the connections comprise both mechanical connection elements for establishing a mechanical releasable connection of the frame parts and connectors for a releasable coupling of the parts of the passage line.

13. The slurry wall cutter in accordance with claim 12, wherein the connections are quick-coupling connections for a simultaneous connection of the frame parts and the parts of the passage line.

14. A cable excavator comprising the slurry wall cutter in accordance with claim 11.

15. The cable excavator of claim 9, wherein the upper frame part or the lower frame part comprises an electronic control unit; or the lower frame part comprises a suction opening and a conveying pump in communication therewith for conveying excavated material produced by the at least one cutting tool.

16. The slurry wall cutter in accordance with claim 11, wherein the upper frame part or the lower frame part comprises an electronic control unit; and the lower frame part comprises a suction opening and a conveying pump in communication therewith for conveying excavated material produced by the at least one cutting tool.

17. The slurry wall cutter in accordance with claim 11, wherein the slurry wall cutter is operable both with and without an installed middle frame part.

18. The carrier machine comprising a slurry wall cutter in accordance with claim 11.

* * * * *